US005522407A

United States Patent [19]

Kelsey

[11] Patent Number: 5,522,407

[45] Date of Patent: Jun. 4, 1996

[54] HEATED HAIR CLIP

[75] Inventor: Martha Kelsey, Fairfield, Iowa

[73] Assignee: Uptown Products, Inc., Fairfield, Iowa

[21] Appl. No.: 327,962

[22] Filed: Oct. 24, 1992

[51] Int. Cl.[6] ..... A45D 4/18

[52] U.S. Cl. ..... 132/231; 132/277; 132/234

[58] Field of Search ..... 132/277, 231, 132/234; 219/222

[56] References Cited

U.S. PATENT DOCUMENTS

| | | | |
|---|---|---|---|
| 1,992,388 | 2/1935 | Moseley | 132/231 |
| 2,134,869 | 11/1938 | Freudenberg | 132/234 |
| 2,143,740 | 1/1939 | McIntosh . | |
| 2,621,280 | 12/1952 | Judd | 132/229 |
| 2,708,941 | 5/1955 | Field . | |
| 2,862,507 | 12/1958 | Hawthorne . | |
| 3,600,552 | 8/1971 | Tolmie et al. | 219/222 |
| 3,701,882 | 10/1972 | Wada et al. | 219/222 |
| 3,702,119 | 11/1972 | Solomon . | |
| 5,294,777 | 3/1994 | Denhup . | |

*Primary Examiner*—Cary E. O'Connor
*Assistant Examiner*—Pedro Philogene
*Attorney, Agent, or Firm*—James C. Nemmers

[57] ABSTRACT

A heatable hair clip that has a pair of normally closed jaws that can be opened by the user gripping finger grips at the end of the clip opposite the jaws. Inside of the jaws are heatable plates that are mounted for universal movement so that they can be positioned over and around U-shaped hair curlers which the user employs to curl the hair in a desired configuration. Small clips are used to hold the hair in place on the curler, and the heated clips are then placed over the curler and small clips to set the hair. An electric heating unit is used to heat the heatable plates of the clips until they are applied to the hair.

8 Claims, 2 Drawing Sheets

HEATED HAIR CLIP

BACKGROUND OF THE INVENTION

This invention relates to a hair clip that can be heated and then used to shape an individual's hair.

Over the years, there have been developed and are currently available numerous types of hair curlers and clips that can be used in styling the hair to produce different looks. For example, curlers are used to provide curls or waves to the hair, and frequently the hair is heated using a heated curling iron or electrically heated rollers or the like that provide lift or volume to the hair so that the individual's hair will have a full-bodied natural look or a wavy appearance, depending upon what is used. When the hair is heated, it will set the hair so as to retain the general configuration of the hair at the time the heat was applied.

There are known and available electrically heated curling irons and electrically heated rollers, but these are somewhat limited in the hair styles that can be produced using such devices. In addition, there are numerous curlers and rollers of different sizes and shapes which can be used and applied when the hair is wet with the hair then allowed to either naturally dry or dried using a hair dryer. Also, recently issued Denhup U.S. Pat. No. 5,294,777 discloses the use of a hair clip that includes a pair of interior metal plates that are heated by applying them to a heated plate of an electric heating unit. These heated hair clips are then used to style dry or damp hair into a linear configuration generally perpendicular to the scalp, but they cannot be used to produce curls or waves. These heated hair clips are thus limited for use in producing a particular hair style which has lift and volume, and they cannot be used with hair curlers to curl or wave the hair.

There is therefore a need for an improved method of applying heat to curled hair to set the curled hair in the configuration produced by a particular hair curler. There is a further need for a simple, easy to use way of applying heat to set curled hair. It is an object of this invention to fulfill and satisfy those needs.

SUMMARY OF THE INVENTION

The invention employs unique hair clips that have a pair of normally closed jaws that can be opened by the user gripping finger grips at the end of the clip opposite the jaws. Inside of the jaws are heated plates that are mounted for universal movement. The heated hair clips are of a size that they can be placed over and around U-shaped hair curlers which the user employs to curl the hair in a desired configuration. Small clips are used to hold the hair in place on the curler, and the heated clips are then placed over the curler and small clips. An electric heating unit is provided that has heated plates onto which the heated clips can be placed with their interior plates in contact with the heated plate to heat the clips until they are applied to the hair.

DESCRIPTION OF THE PREFERRED EMBODIMENTS OF THE INVENTION

Figure 1:
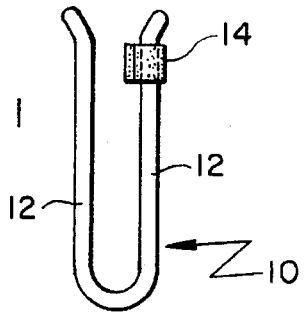
FIG. 1 is a plan view showing a curler with a small hair retaining clip in place.
Figure 2:
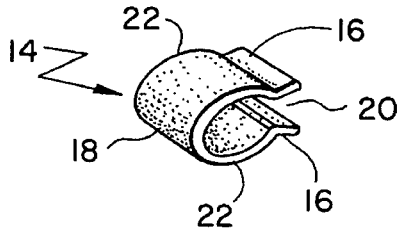
FIG. 2 is a perspective view of the retaining clip shown in FIG. 1.

Referring first to FIGS. 1 and 2, there is illustrated a U-shaped hair curler 10 of known design and having a pair of parallel legs 12, the free ends of which are commonly flared outwardly. Also, the curler 10 is preferably formed from a single piece and the cross-sectional shape of its legs 12 are generally round. FIG. 2 shows a small flexible clip 14 that is preferably formed into a single piece from a suitable material, such as stainless steel or aluminum, that has some resilience and is heat conductive. Clip 14 has a pair of jaws 16 connected at end 18 and open at end 20 where the free ends of the jaws are flared outwardly. Also, the jaws 16 have formed in them convex portions 22. The structure of the clip 14 is so that the clip can be slipped over one of the legs 12 of the curler 10 after hair has been wound over and around the curler 10, most commonly in a generally figure eight pattern. FIG. 1 illustrates the flexible clip 14 in place on a leg 12 of the curler 10, but the hair is not shown. It is the function, however, of the flexible clip 14 to hold the free ends of the hair in place on the cutler 10.

FIGS. 3 through 6 illustrate one embodiment of a heated hair clip constructed according to the principles of the invention. The hair clip is indicated generally by the reference numeral 24 and includes a pair of jaws 26 that are spaced apart on a pivotal support 28. Each pivotal support 28 has a portion 30 extending generally transversely to one of the jaws, with portion 30 terminating in a rounded end. The opposite one of the jaws 26 similarly has a portion 32 extending generally perpendicular to it and terminating in a concave rounded portion that nests with the portion 30 of the other jaws thus providing the pivotal support 28. The jaws 26 are biased into a closed position (see FIG. 6) by a spring steel member 34 positioned between the pivotal supports 28.

Each of the jaws 26 has a finger grip portion 36, each portion 36 extending outwardly from the general plane of the jaw 26. Also, finger portions 36 are preferably provided with depressions 38 (see FIG. 3) to make the jaws 26 easier and more comfortable for the user to grip.

Positioned inside of the jaws 26 are a pair of plates 40 which are formed of heat conductive material such as aluminum or steel. Each of the plates 40 has a projection 42 that is rounded so as to fit into a circular shaped socket 44 formed in the inside surface and near the center of each of the jaws 26. The plates 40 thus can pivot freely about the ball and socket type joint thus formed. This universal movement of the plates 40 permits them to pivot so as to conform and provide maximum contact with the hair wound around the curler 10 when the heated hair clip 24 is placed over the curler 10.

Figure 3:
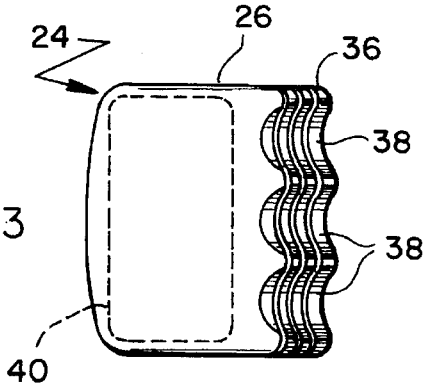
FIG. 3 is a top or plan view of one embodiment of the heated hair clip of the invention.

As best understood by viewing FIGS. 1 and 3 which are approximately to the same scale, the width of the heated plates 40 is approximately equal to the length of the curler 10 so as to completely cover hair wound around the legs 12 of the curler 10. Thus, after the user has wound his or her hair around the legs 12 of the curler 10 and has applied the flexible clip 14 to hold the free ends of the hair in place on the curler 10, the clip 24 (after plates 40 have been heated) is grasped by the user and the jaws 26 opened by the user squeezing together the finger grip portions 36. The heated hair clip 24 can then be slipped over the curler 10 and the hair wound around it leaving the flexible clip 14 in place. After the heated hair clip 24 has been in place a sufficient time to set the hair, the heated hair clip 24, flexible clip 14 and curler 10 can be removed.

Figure 3A:
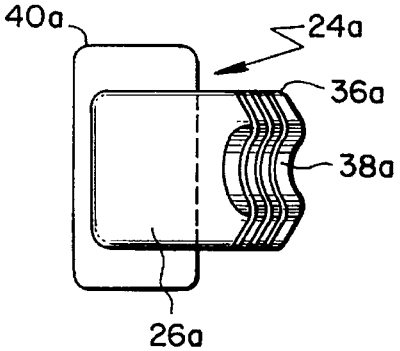
FIG. 3A is a top or plan view of another embodiment of the heated hair clip of the invention.
Figure 4:
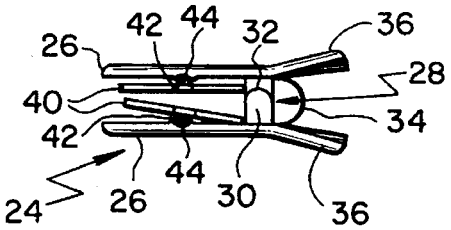
FIG. 4 is a side elevational view of the heated hair clip of FIG. 3.
Figure 5:
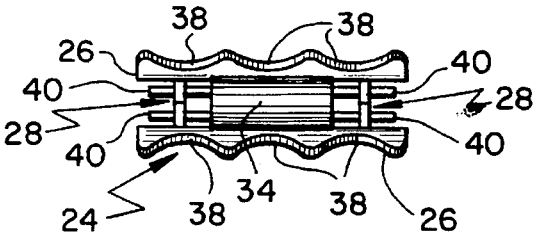
FIG. 5 is an end view of the heated hair clip of FIGS. 3 and 4.
Figure 6:
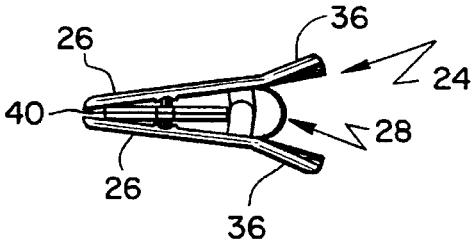
FIG. 6 is a side elevation view of heated hair clip of FIGS. 3, 4 and 5, and showing the jaws in a closed position.

FIG. 3A illustrates another embodiment of the heated clip 24 of FIGS. 3–6, with components of the embodiment of FIG. 3A being referred to by the same reference numeral as the corresponding components of FIG. 3 but with the addition of the letter "a". Thus, the heated hair clip 24a has a pair of jaws 26a spaced apart on a pivotal support (not shown) substantially identical to the support 28 of the embodiment of FIGS. 3–6. Jaws 26*a* also each have a finger grip portion 36*a* with a depression 38*a* to facilitate gripping of the clip 24*a* by the user. Clip 24*a* also has positioned inside the jaws 26*a* a pair of heatable plates 40*a* mounted for universal movement. Plates 40*a* are mounted inside the jaws 26*a* in the same manner as plates 40 as shown in FIGS. 4 and 6. As in the embodiment of FIGS. 3–6, the width of the plates 40*a* is approximately equal to the length of the curler 10 so that the plates 40*a* cover substantially all the hair wound around the curler 10. The primary difference between the embodiments of FIG. 3 and 3A is the width of the jaws 26 and 26*a*, the jaws 26*a* being narrower than the plates 40*a* in the embodiment of FIG. 3A.

Figure 10:
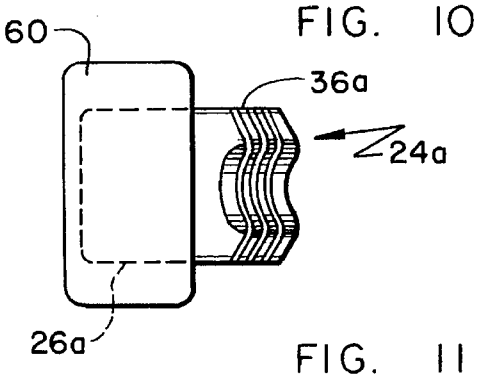
FIG. 10 is a top view similar to FIGS. 3 and 3A but showing another embodiment of the invention with an insulating cover over the heating element.
Figure 11:
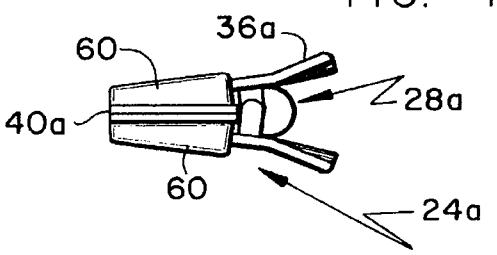
FIG. 11 is a side elevational view similar to FIG. 6 but showing the embodiment of FIG. 10.

FIGS. 10 and 11 illustrate another embodiment similar to the embodiment of FIG. 3A, but showing the addition of an insulating cover over the heatable plates 40*a*. In this embodiment, a piece of insulating material 60 that is non-heat conducting is secured to and covers the outside of the jaws 26*a* and the outside surfaces of the plates 40*a*. Each pad of the insulating material 60 is preferably thin and flexible and one piece so that it will conform to the surfaces of the jaws 26*a* and the plates 40*a* and will not interfere with the pivoting of the plates 40*a*. In the alternative, the insulating material 60 can be made in two pieces, one covering each jaw 26*a* and the other somewhat U-shaped to cover the plate 40*a*. If insulating material is used for the embodiment of FIG. 3, it will, of course, be of a single piece and will be secured only to the outside surface of each jaw 26, since in this embodiment the plates 40 are completely covered by the jaws 26. In either case, the purpose of the insulating material 60 is to prevent any discomfort to the user of the heated clip by direct contact of the clip with the user's scalp.

Figure 7:
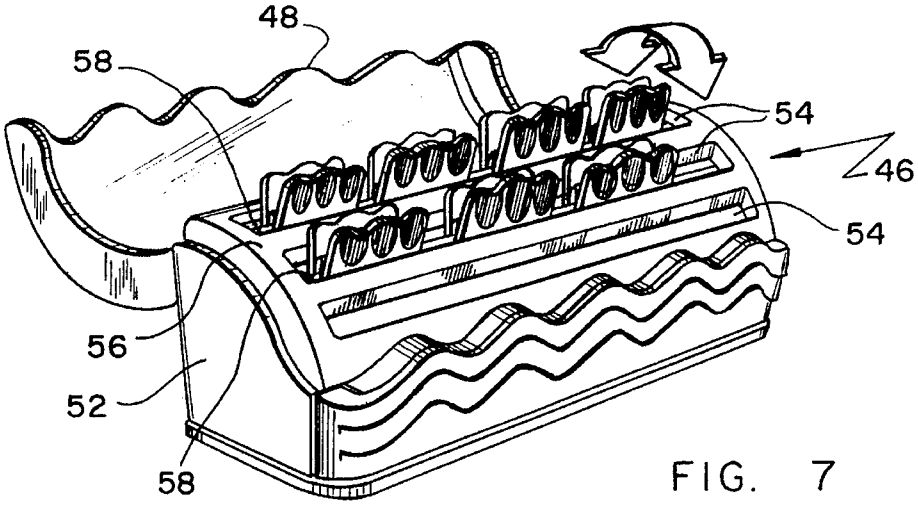
FIG. 7 is a perspective view of a heating unit for heated clips.
Figure 8:
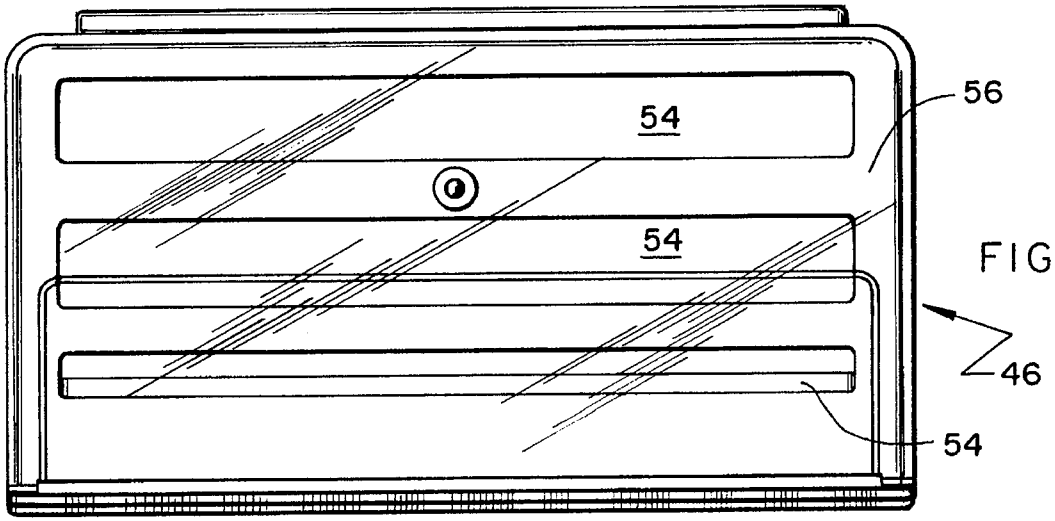
FIG. 8 is a top view of the heating unit of FIG. 7.
Figure 9:
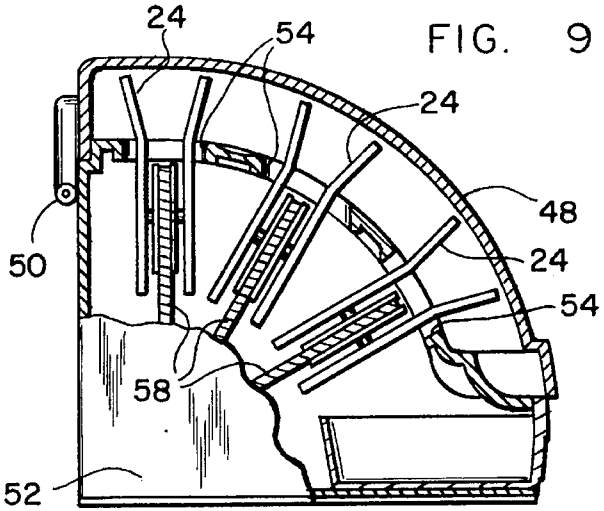
FIG. 9 is an end or side view of the heating unit of FIGS. 7 and 8 with a portion of the side removed to show the interior structure.

FIGS. 7, 8 and 9 illustrate a heating unit that is suitable for heating the plates 40 or 40*a* of the hair clips 24 and 24*a*. The heating unit, indicated generally by the reference numeral 46, preferably has a cover 48 pivotly mounted by hinge 50 to the main body 52 of the unit 46. This permits the cover 48 to be moved from a fully open to a fully closed position, the cover being shown in the fully closed position in FIG. 9 and in the fully open position in FIG. 7. The main body 52 of the heating unit 46 has a plurality of slots 54 formed in the upper surface 56, which slots 54 extend from side to side of the main body 52. Slots 54 provide access to heating elements 58 which are formed in the shape of relatively thin rectangular plates that extend from end to end of the slots 54. The heating elements 58 are electrically connected in an electrical circuit (not shown) that will through electrical resistance heat the elements 58 to the desired temperature.

In use, the hair clips 24 or 24A are positioned side by side along one or more of the elements 58 with the plates 40 of the clips 24 (or plates 40*a* of the clip 40*a*) in contact with one of the elements 58 as illustrated in FIG. 9. Since the jaws 26 or 26*a* of each clip 24 or 24*a* are biased to a closed position by the spring steel member 34, the clips 24 or 24*a* will be retained on an element 58 until the plates 40 or 40*a* are heated. The user then merely grips the finger portions 36 or 36*a* of each clip 24 or 24*a*, squeezes the portions 36 or 36*a* together, and removes the clip 24 or 24*a* from the element 58 and then positions the clip 24 or 24*a* over the curler 10 and the hair wound around the curler 10 in the manner previously described.

From the foregoing description, it is evident the invention provides a quick and easy means to apply heat to hair wound around hair curlers. The pivoting plates 40 or 40*a* of each clip 24 or 24*a* provide for maximum contact with the hair and thus the most efficient application of heat to produce the desired setting of the hair. Although the clips 24 and 24*a* have been described in the preferred embodiments as being used in connection with U-shaped hair cutlers, it will be evident that the clips 24 and 24*a* can be used with curlers of other configurations or can be used by applying the clips directly to the hair.

Having thus described the invention in connection with preferred embodiments thereof, it will be obvious to those skilled in the art that various revisions and modifications can be made to the preferred embodiments disclosed herein without departing from the spirit and scope of the invention. It is my intention, however, that all such revisions and modifications as are obvious to those skilled in the art will be included within the scope of the following claims.

What is claimed is as follows:

1. A hair clip for heating and styling into waves or curls the hair of a user wound around and held by a hair curler, said hair clip comprising: a pair of spaced-apart jaws each having an inside surface facing the inside surface of the other jaw and a finger grip portion at one end of the jaw and a hair engaging portion at the other end of the jaw, a pivotal support between the ends of the jaws near the finger grip portions to hold the jaws in spaced-apart position and to provide for relative pivotal movement of the jaws so that the inside surfaces of the jaws can be moved toward and away from each other, means biasing the hair engaging portions of the jaws toward each other so that the jaws are normally in a closed position until the jaws are opened by the user moving the finger engaging ends of the jaws toward each other, and a heating plate pivotly mounted to the inside surface of each jaw independently of the pivotal support of the jaws and at a pivot point between the pivotal support of the jaws and the said other end of each jaw so as to provide for universal movement of the heating plate relative to the jaw, the heating plates being constructed of a heat conductive material.

2. The hair clip of claim 1 in which the means biasing the jaws toward each other is a spring steel member positioned between the finger engaging portions of the jaws.

3. The hair clip of claim 1 in which the jaws are greater in width than the distance from end to end, and the finger grip portions contain depressions to accommodate the fingers of the user.

4. The hair clip of claim 3 in which the heating plates are each flat and rectangular in shape with the longer dimension of the rectangle extending from side to side of the jaws so that the heating plates cover substantially all of the inside surfaces of the jaws between the hair engaging portions of the jaws and the pivotal support.

5. The hair clip of claim 4 in which the heating plates are in substantially full contact with each other when the jaws are in their normally closed position.

6. The hair clip of claims 1, 2, 3, 4 or 5 in which insulating material is secured to and covers the outside surfaces of the heating plates and the outside surfaces of the those portions of the jaws covering the heating plates.

7. A hair styling and heating system comprising in combination: a hair curler of a generally U-shape with elongated spaced-apart legs, a hair retaining clip removably attachable to a leg of the curler to hold the hair on the curler after the hair has been wound around the curler, and a heating hair clip for heating and styling into waves or curls the hair of a user wound around and held by the hair curler, said heating hair clip comprising; a pair of spaced-apart jaws each having an inside surface facing the inside surface of the other jaw and a finger grip portion at one end of the jaw and a hair engaging portion at the other end of the jaw, a pivotal support between the ends of the jaws to hold the jaws in spaced-apart position and to provide for relative pivotal movement of the jaws so that the inside surfaces of the jaws can be moved toward and away from each other, means biasing the hair engaging portions of the jaws toward each other so that the jaws are normally in a closed position until the jaws are opened by the user moving the finger engaging ends of the jaws toward each other, and a heating plate pivotly mounted to the inside surface of each jaw for universal movement relative to the jaw, the heating plates being constructed of a heat conductive material and being of a sufficient size that the plates cover substantially all of the curler, the hair retaining clip and the hair wound around the curler when the curler is positioned between the jaws of the heating hair clip.

8. The hair styling system of claim 7 in which the hair retaining clip is a one-piece structure of resilient material having a pair of jaws pivotly connected at one end, the jaws being open at the other end to provide for attaching the hair retaining clip to a leg of the curler.

* * * * *